US007871148B2

(12) United States Patent
Scanlan

(10) Patent No.: US 7,871,148 B2
(45) Date of Patent: Jan. 18, 2011

(54) UNIVERSAL INKJET CARTRIDGE PRINTHEAD SEALING BAND

(75) Inventor: David Scanlan, Sarasota, FL (US)

(73) Assignee: Phoenix Ink Corporation, Sarasota, FL (US)

( * ) Notice: Subject to any disclaimer, the term of this patent is extended or adjusted under 35 U.S.C. 154(b) by 97 days.

(21) Appl. No.: 12/319,936

(22) Filed: Jan. 14, 2009

(65) Prior Publication Data

US 2010/0177140 A1 Jul. 15, 2010

(51) Int. Cl.
*B41J 2/165* (2006.01)

(52) U.S. Cl. ..... 347/29

(58) Field of Classification Search ..... 347/29, 347/86

See application file for complete search history.

(56) References Cited

U.S. PATENT DOCUMENTS 6,481,825 B1 * 11/2002 Hinami et al. ..... 347/29

* cited by examiner

*Primary Examiner*—shih-wen hsieh
(74) *Attorney, Agent, or Firm*—McDermott Will & Emery LLP

(57) ABSTRACT

An inkjet cartridge printhead seal that is an elastomeric band with an outer perimeter, an inner perimeter and a width. The inner and outer perimeters define at least a first and a second thickness, with the second thickness greater than the first thickness. The band also has a seal located along the portion of the band that has the second thickness.

6 Claims, 2 Drawing Sheets

UNIVERSAL INKJET CARTRIDGE PRINTHEAD SEALING BAND

FIELD OF THE INVENTION

The present subject matter relates to an inkjet cartridge printhead seal. Specifically, the present subject matter relates to a universal sealing band for sealing the printhead while it is being filled or refilled, shipped, stored or otherwise not installed in a printer.

BACKGROUND OF THE INVENTION

Inkjet printers are widely used. These printers utilize cartridges containing ink. The ink is ejected from print head nozzles located on the cartridge, and laid onto paper or other media. The cartridge may contain ink of a single color, or may contain multiple inks of different colors to create color images. Used or spent inkjet cartridges may be refilled with ink and reused. The nozzles should be sealed whenever the cartridge is not installed in the printer in order to prevent the ink from drying and blocking the nozzles. In particular, the nozzles must be sealed when the cartridge is being refilled.

Several types of inkjet cartridge storage and seal containers are known in the art. For example, U.S. Pat. No. 6,588,875 to Kleinhammer discloses an inkjet cartridge printhead seal comprising an elastomeric seal and a flexible sheet with an adhesive on one side which holds the seal compressed against an inkjet cartridge printhead nozzle plate.

However, the prior art does not teach a simplified, unitary inkjet cartridge printhead seal. For example, the printhead seal disclosed by Kleinhammer is comprised of several components, including a sheet of flexible material coated with an adhesive, a seal, a release liner, and a finger pull tab. Assembling the seal out of these components may be costly and time-consuming. Furthermore, in order to install Kleinhammer's printehead seal, it is necessary to remove the release liner, align the seal with the nozzle plate, and press the adhesive surface against the sides of the cartridge with enough force to generate a secure seal. This method is vulnerable to misalignment of the seal with the nozzle plate, and incomplete sealing of the adhesive to the cartridge. Any mistake in installation would lead to the ink spilling or drying when the cartridge is subsequently shipped or stored.

Accordingly, there is a need for a unitary, nearly universal inkjet printhead seal that is easy to manufacture and install.

SUMMARY OF THE INVENTION

The above and other needs are met by the disclosed embodiments which provide an elastomeric band for sealing inkjet cartridge print heads. The inner and outer perimeters of the band define at least a first and a second thickness. The band includes a seal located along a portion of the band which includes the second thickness which will most commonly be the greater thickness.

The unitary elastomeric band forms a securing portion and a seal. The seal is adapted to seal the nozzle plate of an inkjet cartridge via a compression fit between the seal and the nozzle plate. The securing portion provides the compressive force required for the seal to seal the nozzle plate.

The one piece elastomeric band includes an outer perimeter that is substantially circular, and an inner perimeter that is substantially in the shape of a circle whose enclosed area is reduced by a chord. The inner and outer perimeters define the thickness of the band, which is increased along the radial angle of the inner perimeter that includes the chord.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by the features particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

It is contemplated that the subject matter described herein may be embodied in many forms. Accordingly, the embodiments described in detail below are the presently preferred embodiments, and are not to be considered limitations.

Figure 1:
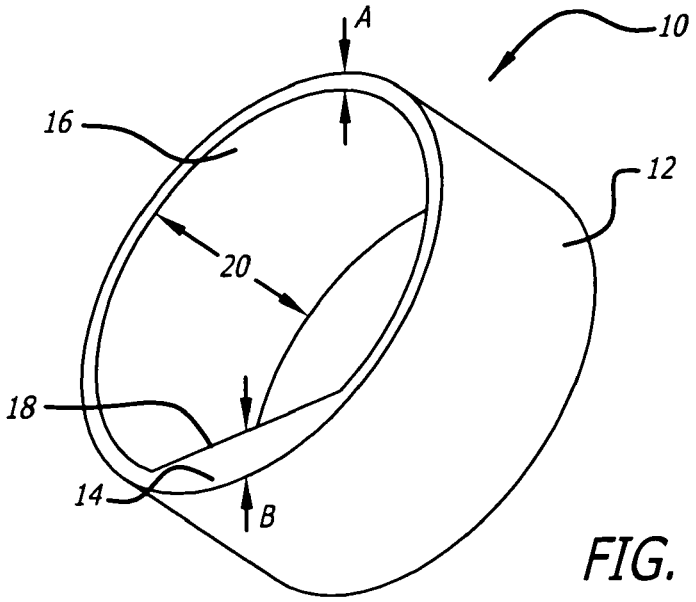
FIG. 1 shows a perspective view of a universal inkjet cartridge printhead sealing band.
Figure 2:
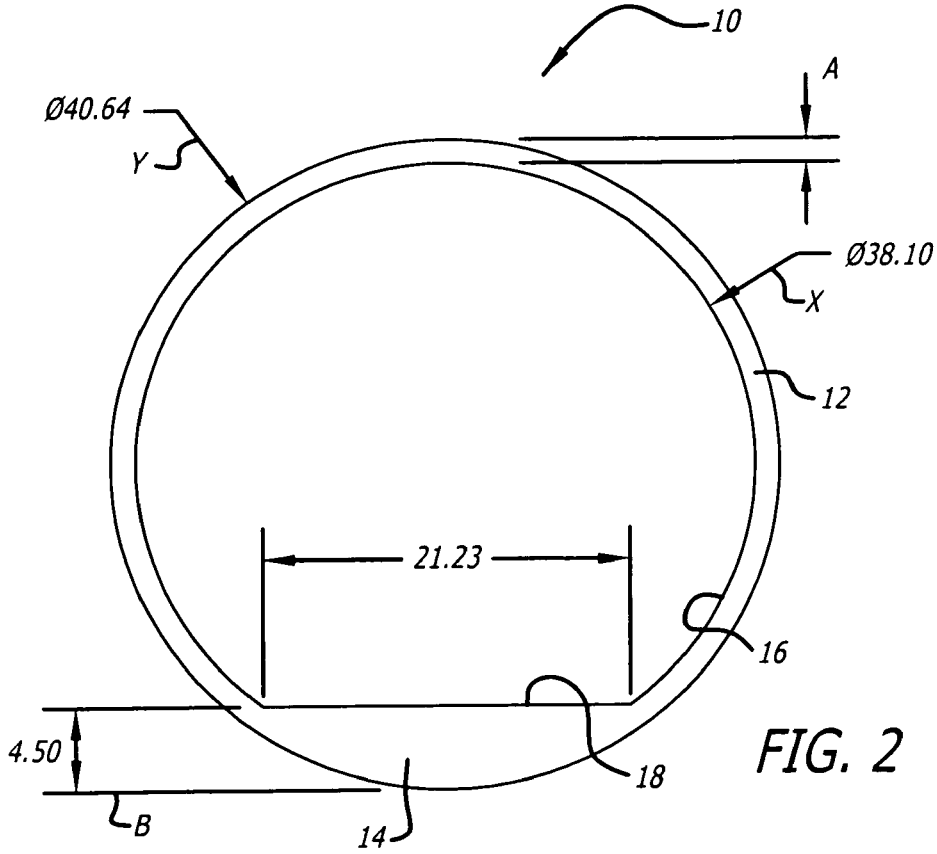
FIG. 2 shows a cross-sectional view of the sealing band shown in FIG. 1.

The universal sealing band 10, shown in FIGS. 1 and 2 is elastomeric. In embodiments of the present invention, the universal sealing band 10 of the present invention comprises a polymeric material or a mixture of polymeric and non-polymeric materials. It is to be understood that the term universal sealing band is meant to include any shape, size, color or grade of band for sealing the printhead while it is being filled or refilled, shipped, stored or otherwise not installed in a printer.

More specifically, the universal sealing band 10 may be made from polymeric materials such as elastomers. Elastomeric materials useful in the practice of the invention are exemplified, but not limited to, polysiloxanes and natural or synthetic latex.

Polysiloxanes are defined as polymers in which their backbones consist of Si—O—Si units. Polysiloxanes are also referred to as silicone rubbers. A preferred polysiloxane for the practice of this invention is polydimethyl methyl vinyl silicone.

A latex refers to a stable dispersion (emulsion) of polymer microparticles in an aqueous medium. Latexes may be categorized as either natural or synthetic. Synthetic latex is made by polymerizing a monomer that has been emulsified with surfactants. Natural latex is found in the milky sap of many plants that coagulates on exposure to air.

Of course, other polymeric materials such as thermoplastic materials are also contemplated by the present invention.

The universal sealing band 10 of the present invention may also comprise in addition to the polymeric materials described above other materials which may be exemplified, but not limited to silicon dioxide ($SiO_2$), substituted silicon compounds, DCBP (2,4-dichlorobenzoyl peroxide), and DBPMH (2,5-dimethyl-2,5-di[t-butylperoxy]hexane). The addition of these materials in the manufacturing of the universal sealing band will, of course, be depended on the requirements of the final product.

In the present invention, the material used to make the universal sealing band 10 possesses certain physical characteristics. These physical characteristics can be exemplified, but not limited to, elasticity and hardness of material.

Elasticity may be defined as the ability of material used to construct the sealing band to be stretched without breaking or tearing.

The hardness of a material is defined as the material's resistance to permanent indentation. The measurement of hardness in polymers, elastomers and rubbers is obtained by the use of a durometer device.

Duromety, like many other hardness tests, measures the depth of an indentation in the material created by a given force on a standardized presser foot. This depth is dependent on the hardness of the material, its viscoelastic properties, the shape of the presser foot, and the duration of the test. ASTM D2240 durometers allow for a measurement of the initial hardness, or the indentation hardness after a given period of time The basic test requires applying the force in the consistent manner, without shock measuring the hardness (depth of the indentation). If a timed hardness is desired, force is applied for the required time and then read.

The final value of the hardness depends on the depth of the indenter. If the indenter penetrates 2.5 mm or more into the material, the durometer number is 0 for that scale. If it does not penetrate at all, then the durometer number is 100 for that scale. It is for this reason that multiple scales exist. The durometer measurement or number value is a dimensionless quantity, and there is no simple relationship between a material's durometer measurement in one scale, and its durometer measurement in any other scale, or by any other hardness test.

It has been found that materials which have durometer measurement of between about 10 to 40 and preferably 30.

The value may vary depending upon the size of the band to be used, which may be dictated by the size or shape of the cartridge with which it is to be used. For typical size inkjet cartridges, it has been found that about 30 durometer works well.

As shown, the elastomeric band 10 has an outer perimeter 12, an inner perimeter 16 and a width 20. The inner perimeter 16 and outer perimeter 12 define at least a first thickness A, and a second thickness B. A seal 14 is located along a portion of band 10 where the band has the second thickness B. As shown, the seal 14 has a variable thickness which is greater than thickness A and is integrally formed of the same material as the rest of the band 10.

As shown in FIG. 1, the second thickness B is greater than the first thickness A. However, it is contemplated that the two thicknesses A and B may be of any proportion with respect to each other and, alternatively, there may be additional thicknesses.

In the example shown in FIGS. 1 and 2, the outer perimeter 12 of band 10 is substantially in the shape of a circle with diameter Y, and inner perimeter 16 is substantially in the shape of a circle with diameter X, excluding the portion corresponding to seal 14. Because the band 10 is made of an elastomeric material, the band 10 may be other shapes, or stretched into other shapes. As shown in FIG. 1 and further in FIG. 2, seal 14 preferably has a flat face 18 which results in the inner perimeter 16 having the shape of a circle whose enclosed area is reduced by a chord. However, the seal 14 may be in other forms or shapes, such as, for example, the inner perimeter 16 may be generally in the shape of an oval. It is understood that face 18 may also include features corresponding to features on nozzle plate 24, as discussed below.

Figure 4:
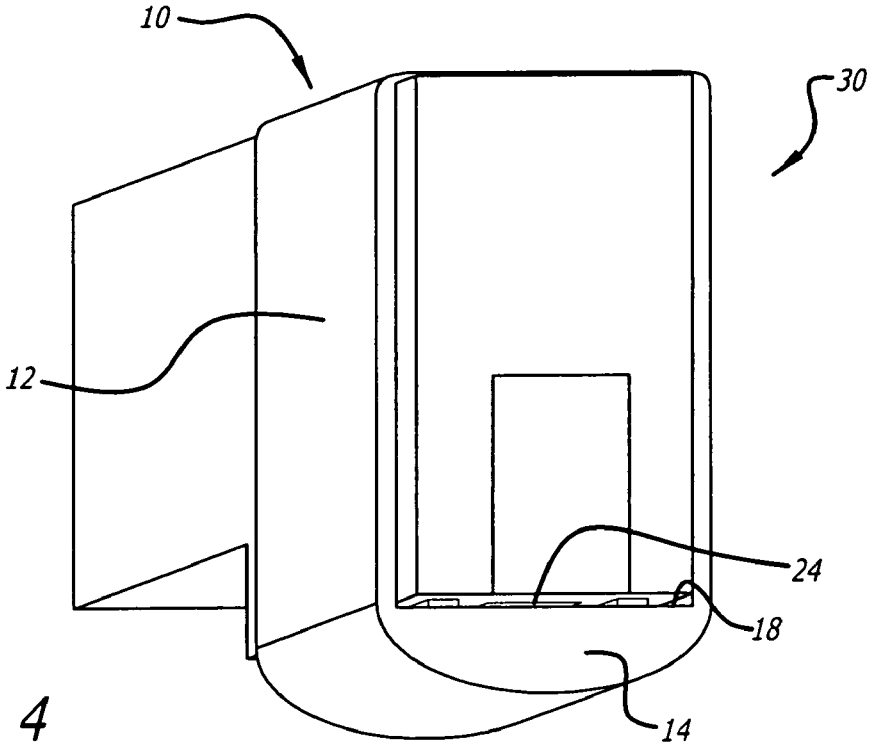
FIG. 4 shows an embodiment of the sealing band shown in FIG. 1 used with an inkjet cartridge.

The outer perimeter 12 and inner perimeter 16 of the band 10 are selected so that the band 10 may be used in conjunction with an inkjet cartridge 30 to seal the print head 26, as shown in FIG. 4. It is understood that the outer perimeter 12 and inner perimeter 16 may vary depending on the elastic properties of the material of the band 10, as discussed further below.

In the example shown in FIG. 2, the second thickness B of band 10 is approximately three times the first thickness A. It is understood that both first and second thicknesses A and B may vary depending on the properties of the material of the band 10, as discussed further below. It is further understood that band 10 may include additional thicknesses or that the proportions of thicknesses and lengths of the outer perimeter 12 and inner perimeter 16 spanned by each thickness may vary.

In one example, the elastomeric material of the band 10 comprises primarily polydimethyl methyl vinyl silicone rubber. As shown in FIGS. 1 and 2, in this example, the outer diameter Y is approximately 40.64 cm, and the inner diameter X is approximately 38.10 cm. Thus, the first thickness A of the band is 1.54 cm. However, it is understood the range of inner and outer diameters and thicknesses may vary according to the properties of the elastomeric material, as described further herein.

For example, the outer diameter Y of the band may vary depending on the elasticity of the elastomeric material. If the material is more elastic than the silicone rubber used in the example described above, then less material may be used by reducing the outer diameter Y of the band. If the material is less elastic than the silicone rubber described above, the outer diameter Y may be increased. The first thickness A may also vary depending on the elasticity of the elastomeric material. If the material is highly elastic, the first thickness A may be reduced in comparison to a band with the same outer diameter Y made of less elastic material.

As shown in FIG. 2, the band 10 includes a second thickness B which in part defines the seal 13. Thickness B may vary depending on the porosity of the elastomeric material. In the example described above in which the elastomeric material comprises a silicone rubber, wherein the outer diameter Y is 40.64 cm and the first thickness A is 1.54 cm, the second thickness B is preferably 4.5 cm. However, it is contemplated a range of second thicknesses may be utilized. For example, if the elastomeric material is more porous than the identified silicone rubber, the second thickness may be greater than 4.5 cm in order to provide greater resistance to ink seepage.

Figure 3:
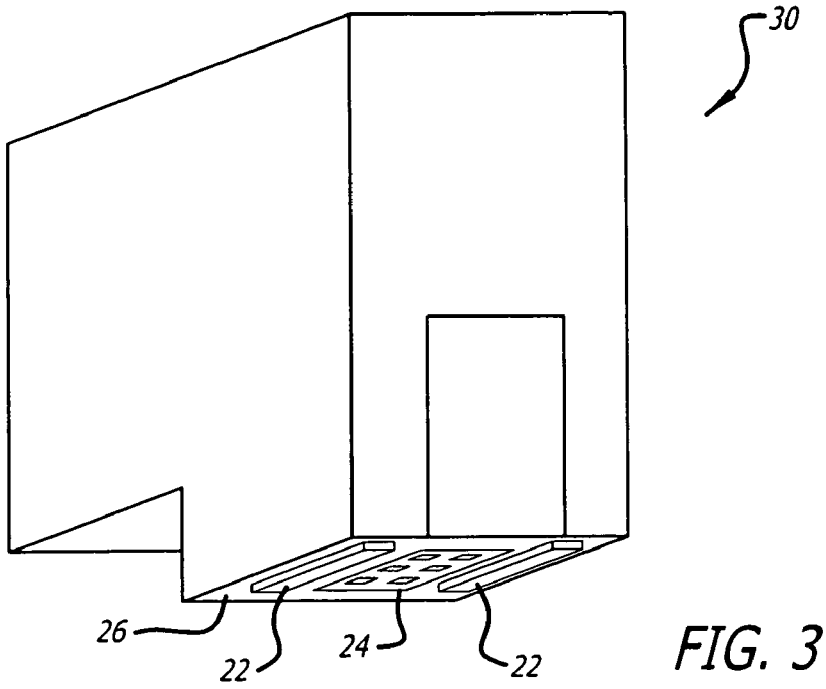
FIG. 3 is a perspective view of a typical inkjet cartridge showing the shoulders and nozzle plate.

Inkjet cartridges typically include two shoulder-like protrusions 22 surrounding the nozzle plate 24, such as the cartridge 30 shown in FIG. 3. The distance between these protrusions may vary between different brands and models of cartridges. The example of the band 10 shown in FIGS. 1 and 2 is sized to fit most existing brands of cartridges. Accordingly, to provide a nearly universal fit, the band 10 may have a width 20 that is greater than the width of known print head nozzle plates 24 and narrower than known protrusions 22. In the example shown, the width 20 of the band 10 is preferably approximately 19 cm. However, it is understood that bands 10 of other widths 20 can be used with multiple brands of cartridges 30.

As shown in FIG. 4, the elastomeric material of the band 10 stretches when applied to an inkjet cartridge 30. Once in use, the band 10 fits snugly around the inkjet cartridge 30, compressing the seal 14 against the nozzle plate 24,. As shown in FIGS. 1 and 2, the seal 14 preferably has a flat face 18 that fits closely against the nozzle plate 24 of the inkjet cartridge 30. The seal face 18 may further include features that enable a better seal with the nozzle plate 24, such as protrusions or contours that correspond to features on the nozzle plate 24.

As discussed above, the outer diameter Y of band 10 may vary depending on the elasticity of the material selected. For example, if the elastomeric material is less elastic than the silicone rubber described in the preferred embodiment above, outer diameter Y of band 10 may be increased in order to allow the less elastic material to be installed around the inkjet cartridge 30.

Also discussed above, the second thickness B of band 10 is preferably greater than first thickness A. As an additional benefit, when the second thickness B is greater than the first thickness A, the second thickness B provides a visual reminder to the user to orient the band 10 on the cartridge 30 so that the seal 14 covers the nozzles 24, as shown in FIG. 4.

The earlier stated needs and others are met by providing a unitary elastomeric band 10 including a seal 14, wherein the seal 14 may be adapted to seal the nozzle plate 24 of an inkjet cartridge 30 via a compression fit between the seal 14 and the nozzle plate 24. The band 10 may be adapted to provide the compressive force required for the seal 14 to seal the nozzle plate 24.

The earlier stated needs and others are met by providing a one piece elastomeric band 10 including an outer perimeter 12 that is substantially circular and an inner perimeter 16 that is substantially in the shape of a circle whose enclosed area is reduced by a chord. The inner perimeter 16 and outer perimeter 12 define the thickness of the band 10. Accordingly, the thickness of the band 10 is increased along the radial angle of the inner perimeter that includes the chord.

The foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents fall within the scope of the invention.

What is claimed is:

1. An inkjet cartridge printhead seal comprising:

a one piece elastomeric band including an outer perimeter that is substantially circular and an inner perimeter that is substantially in the shape of a circle whose enclosed area is reduced by a chord, wherein the inner and outer perimeters define a thickness of the band and therefore a thickness of the band is increased along a radial angle of the inner perimeter that includes the chord.

2. The inkjet cartridge printhead seal of claim 1, wherein the elastomeric band comprises a polymer having a silicone backbone.

3. The inkjet cartridge printhead seal of claim 2, wherein the elastomeric band comprises polydimethyl methyl vinyl silicone rubber.

4. The inkjet cartridge printhead seal of claim 3, wherein the outer diameter of the elastomeric band is approximately 41 cm and a length of the seal is approximately 21 cm.

5. The inkjet cartridge printhead seal of claim 1, wherein a width of the elastomeric band is approximately 19 cm.

6. The inkjet cartridge printhead seal of claim 5, wherein a first thickness of the elastomeric band is approximately 1.5 cm and a second thickness of the elastomeric band including the seal is approximately 4.5 cm.

* * * * *